US010925324B2

(12) United States Patent
Przybylo

(10) Patent No.: US 10,925,324 B2
(45) Date of Patent: Feb. 23, 2021

(54) APPARATUS FOR DISSIPATING SOCK HEAT AND MOISTURE

(71) Applicant: Lukasz Przybylo, Los Angeles, CA (US)

(72) Inventor: Lukasz Przybylo, Los Angeles, CA (US)

( * ) Notice: Subject to any disclaimer, the term of this patent is extended or adjusted under 35 U.S.C. 154(b) by 191 days.

(21) Appl. No.: 16/192,705

(22) Filed: Nov. 15, 2018

(65) Prior Publication Data

US 2020/0154791 A1 May 21, 2020

(51) Int. Cl.
*A41B 11/00* (2006.01)

(52) U.S. Cl.
CPC ..... *A41B 11/00* (2013.01)

(58) Field of Classification Search
CPC . A41B 11/00; A41B 2400/20; A41B 2400/60; A41B 2300/20; A43B 7/085
USPC ..... 2/239
See application file for complete search history.

(56) References Cited

U.S. PATENT DOCUMENTS 1,805,035 A * 5/1931 Branley ..... D04B 1/26 66/178 R
4,151,660 A * 5/1979 Yoshimi ..... A41B 11/005 36/10
5,086,518 A 2/1992 Staley
5,226,194 A 7/1993 Staley
5,575,013 A * 11/1996 Krack ..... A41B 11/00 2/239
5,682,617 A 11/1997 Tumas
5,749,100 A 5/1998 Rosenberg
5,867,838 A 2/1999 Corry
6,334,222 B1 1/2002 Sun
6,931,762 B1 8/2005 Dua
7,107,626 B1 9/2006 Andrews
7,614,257 B2 11/2009 Araki et al.
9,365,960 B2 6/2016 Craig
9,572,703 B2 2/2017 Matthews
9,609,896 B2 4/2017 Crosby
9,957,649 B2 5/2018 Liu
9,961,943 B2 5/2018 Klein
2009/0151051 A1* 6/2009 Chen ..... A41D 13/06 2/240

* cited by examiner

*Primary Examiner* — Katherine M Moran
(74) *Attorney, Agent, or Firm* — Patent Ingenuity, P.C.; Samuel K. Simpson

(57) ABSTRACT

A sock is provided. The sock has an ankle portion that conforms to an ankle of a wearer of the sock. The ankle portion has one or more ankle portion fibers. The sock has a foot portion that covers a foot sole of the wearer of the sock. The foot portion covers at least a portion of an instep of the wearer of the sock. The foot portion covers a portion of toes of the wearer of the sock without covering an exposed area of a remaining portion of the toes of the wearer of the sock. The foot portion comprises one or more foot portion fibers. The sock has a dissipation ring that is adhered to the one or more foot portion fibers adjacent to the exposed area. The dissipation ring dissipates heat and absorption from the remaining portion of the toes of the wearer of the sock.

20 Claims, 5 Drawing Sheets

APPARATUS FOR DISSIPATING SOCK HEAT AND MOISTURE

BACKGROUND

1. Field

This disclosure generally relates to the field of apparel. More particularly, the disclosure relates to a sock worn on the foot of a user.

2. General Background

Users of shoe apparel (e.g., shoes, sneakers, etc.) often place socks on their feet before positioning their feet into the shoe apparel; such placement is advantageous for a number of reasons. First, a sock may prevent friction between the skin of a user's feet and the inside of the shoe apparel, thereby alleviating, or minimizing, the possibility of skin abrasions. Second, the sock may provide extra comfort to the user.

Yet, with the aforementioned advantages come various disadvantages. For example, users of shoe apparel for athletic activities (e.g., running) often experience moisture build-up within the sock; such moisture build-up may lead to skin irritation, discomfort, etc. Further, such users may also experience excess heat, which may lead to general discomfort, and an overall distraction from the activity being performed. As an example, the aforementioned moisture build-up and/or excess heat may lead to athlete's foot.

SUMMARY

In one aspect of the disclosure, a sock is provided. The sock has an ankle portion that conforms to an ankle of a wearer of the sock. The ankle portion has one or more ankle portion fibers.

Further, the sock has a foot portion that covers a foot sole of the wearer of the sock. The foot portion covers at least a portion of an instep of the wearer of the sock. The foot portion covers a portion of toes of the wearer of the sock without covering an exposed area of a remaining portion of the toes of the wearer of the sock. The foot portion comprises one or more foot portion fibers.

Finally, the sock has a dissipation ring that is adhered to the one or more foot portion fibers adjacent to the exposed area. The dissipation ring dissipates heat and absorption from the remaining portion of the toes of the wearer of the sock.

In another aspect of the disclosure, an alternative sock has a strip that has a first end and a second end. The first end is adhered to a first section of the dissipation ring. Further, the second end is adhered to a second section of the dissipation ring.

BRIEF DESCRIPTION OF THE DRAWINGS

The above-mentioned features of the present disclosure will become more apparent with reference to the following description taken in conjunction with the accompanying drawings wherein like reference numerals denote like elements and in which.

DETAILED DESCRIPTION

An apparatus is provided for dissipating heat and moisture from a sock. In particular, a dissipation ring may be adhered to sock fibers adjacent to an exposed area of the sock. For example, the dissipation ring may be adjacent to an exposed area in proximity to one or more toes of a user because that is the area of the foot that generates the most heat and/or moisture during athletic activities. Accordingly, the dissipation ring may prevent, or eliminate, athlete's foot resulting from such heat and/or moisture accumulation in the toe area. The dissipation ring is not limited to particular shape as it may be in the form of a variety of different shaped (e.g., circle, oval, square, rectangle, triangle, etc.), or unshaped (i.e., not conforming to a particular shape), configurations.

Figure 1:
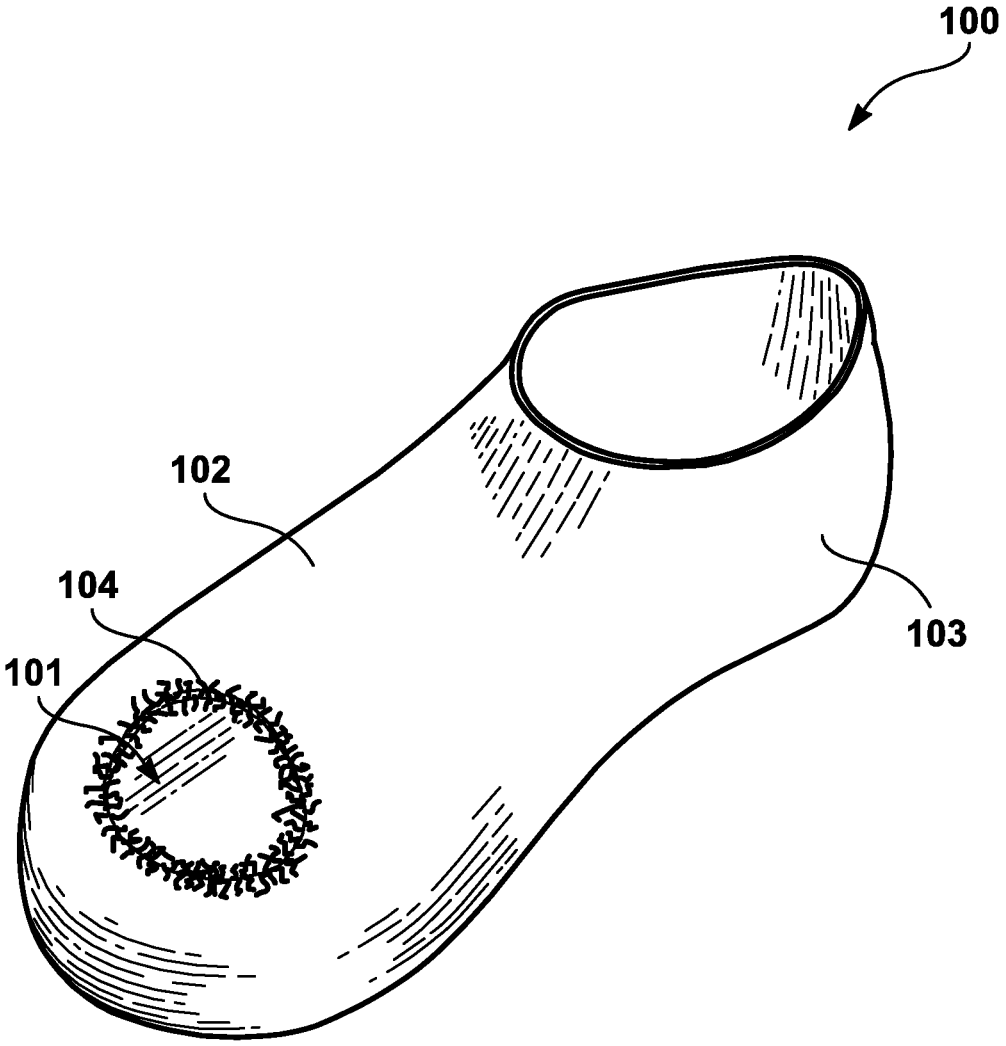
FIG. 1 illustrates a sock with an orifice.

FIG. 1 illustrates a sock 100 with an orifice 101. Although the sock 100 is illustrated with a low-rise ankle portion, the sock 100 could also have a high-rise ankle portion. Accordingly, the sock 100 may be used in athletic contexts, warm climates, or any other environment in which the user may be subject to a higher than normal level of heat and/or moisture.

The sock 100 may be fabricated by adhering (e.g., interweaving, threading, etc.) one or more foot portion fibers 102 to one another. Further, the sock 100 may also be fabricated by adhering one or more ankle portion fibers 103 to one another.

In one embodiment, the sock 100 is fabricated with the orifice 101. In other words, the foot portion fibers 102 are such that the orifice 101 remains in the sock 100 after fabrication. In another embodiment, the sock 100 is fabricated for the sock 100 to cover the entire toe portion of a user, and the orifice 101 is constructed by severing one or more of the foot portion fibers 102.

Accordingly, the orifice 101 is surrounded by a plurality of dangling threads 104 of the foot portion fibers 102. At this stage of fabrication, the sock 100 itself may easily tear upon placement on the foot of a user because of pressure exerted on the dangling threads 104.

Figure 2A:
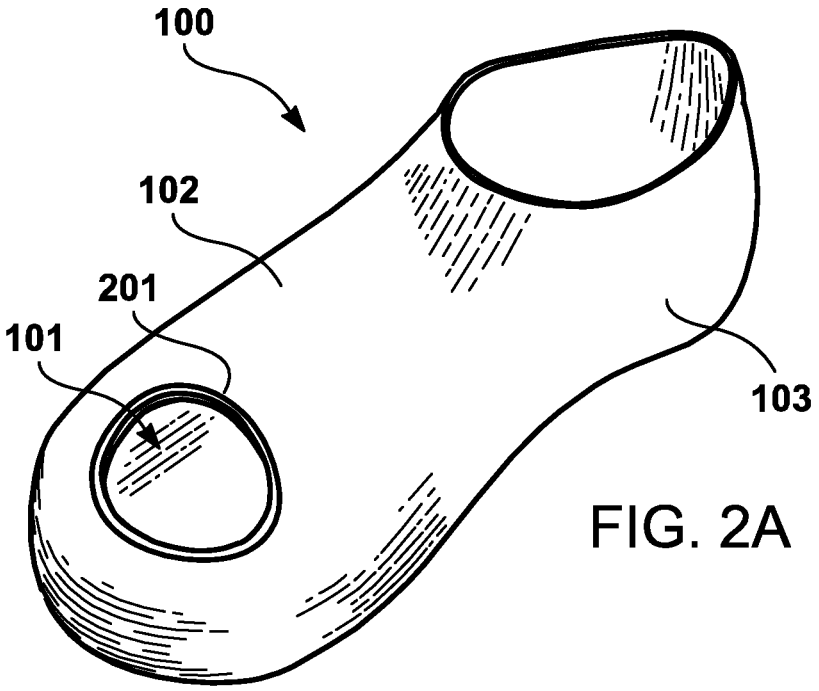
FIG. 2A illustrates the sock illustrated in FIG. 1 with a dissipation ring.

FIG. 2A illustrates the sock 100 illustrated in FIG. 1 with a dissipation ring 201. In particular, the dissipation ring 201 is adhered (e.g., via glue, threading, etc.) to the plurality of dangling threads 104 illustrated in FIG. 1 to prevent, or minimize, tearing of the sock 100.

In one embodiment, the dissipation ring 201 is fabricated to keep the orifice 101 in a position that covers at least a portion of one or more toes of a user wearing the sock 100. In other words, the dissipation ring 201 helps provide, and maintain, ventilation for the portion of the sock 100 that accumulates the most heat and/or absorption—the toe area. Therefore, the dissipation ring 201 dissipates heat and/or absorption through the exposed area of the user's foot (i.e., through the orifice 101).

Further, the dissipation ring 201 is not limited to dissipating heat and/or moisture build-up in the exposed area of the orifice 101. For example, heat and/or moisture that would have been trapped in the non-exposed portion of the sock 100 may travel toward, and through, the orifice 101 maintained by the dissipation ring 201. Accordingly, the dissipation ring 201 provides a conduit for heat and/or moisture to travel externally through the orifice 101. Therefore, the dissipation ring 201 may provide heat and/or moisture dissipation for not only the localized area proximate to the orifice 101, but also remaining parts of the sock 100.

Figure 2B:
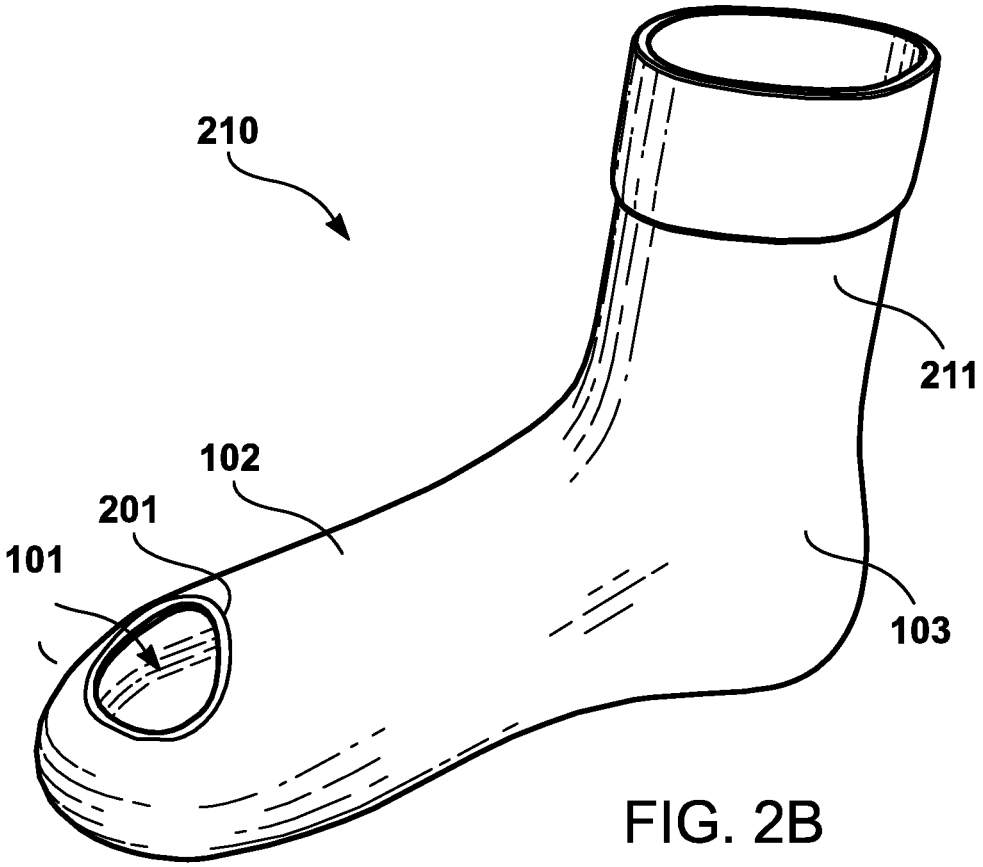
FIG. 2B illustrates a high-rise sock.

As an example of an alternative configuration, FIG. 2B illustrates a high-rise sock 210. The high-rise sock 210 has one or more ankle fibers 211 that extend toward the top of the high-rise sock 210. As an example, a user may want to wear the high-rise sock 210 in a cold climate to keep the foot of the user warm, while still dissipating moisture build-up via the dissipation ring 201.

Although the dissipation ring 201, by itself, alleviates, or at least minimizes, heat and/or moisture absorption, additional materials may be used to further alleviate and/or reduce heat and/or moisture absorption. For example, one or more moisture absorbing/wicking chemicals may be positioned within (e.g., via injection, integration, etc.) the dissipation ring 201. Alternatively, or in addition, the one or more chemicals may be odor absorbents/repellants.

Figure 3:
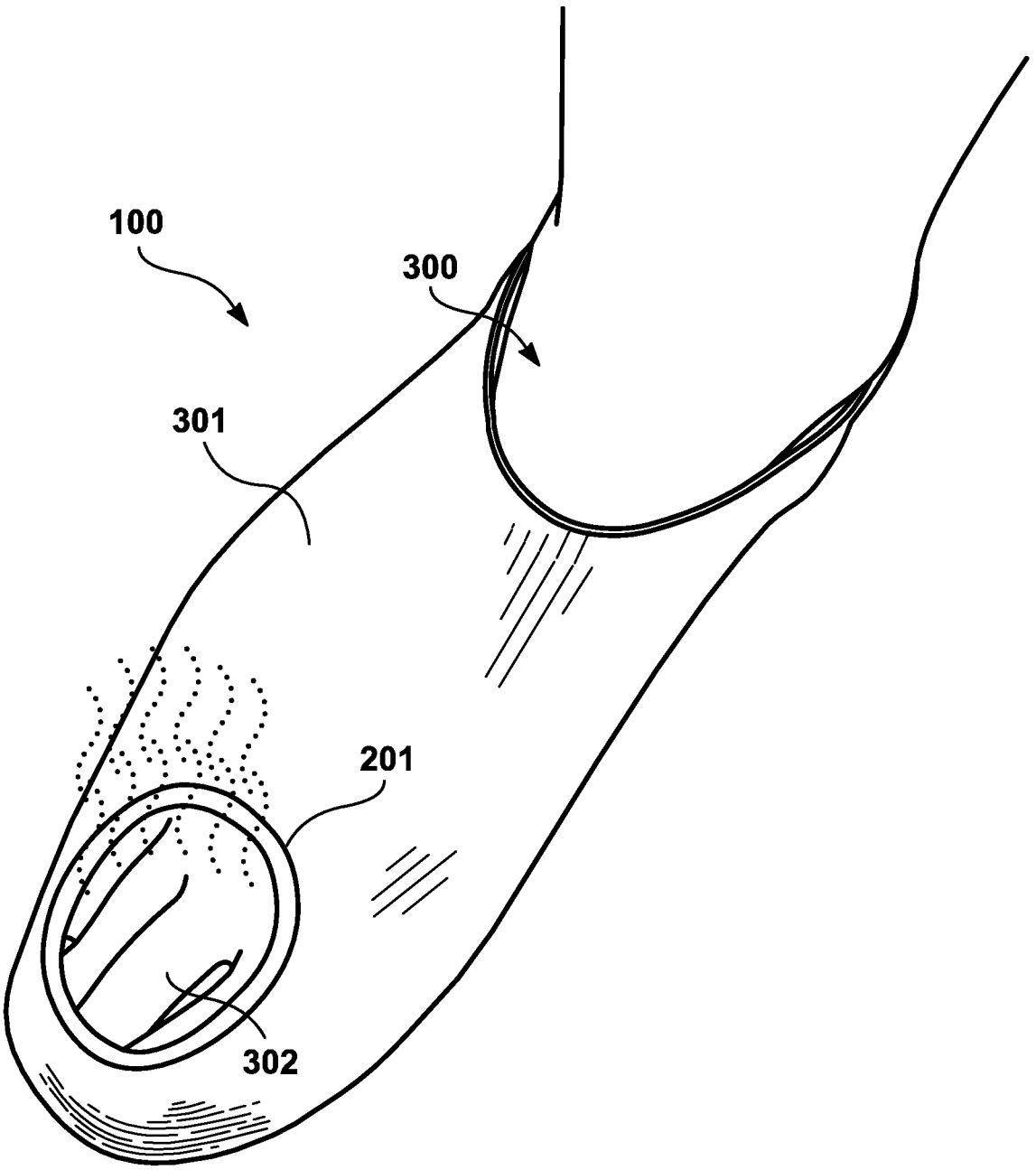
FIG. 3 illustrates a foot of a user on which the sock illustrated in FIGS. 1 and 2A is positioned.

Further, FIG. 3 illustrates a foot 300 of a user on which the sock 100 illustrated in FIGS. 1 and 2A is positioned. The dissipation ring 201 is configured to cover at least a portion of an instep 301 of the foot 300 and a portion of the toes 302. For example, some, or all, of the spaces between the toes 302 may be exposed through the orifice 101 of the dissipation ring 201. Since the spaces between the toes 302 are prone moisture build-up, the dissipation ring 201 dissipates moisture from that area.

By covering at a least a minimal portion of the toes 302 (e.g., toenails), the dissipation ring 201 is configured to maintain the positioning of the sock 100 on the foot 300 of the user. Further, by exposing at least a portion of the instep 301, the dissipation ring 201 dissipates moisture and/or heat away from other parts of the foot 300.

In an alternative embodiment, the dissipation ring 201 may be positioned only over the toes 302, without exposing the instep 301. For example, in a colder climate, a user may want to keep as much of the foot warm as possible, but may only be concerned with avoiding moisture build-up. Accordingly, the dissipation ring 201 may dissipate heat away from the toes 302, but also allow the sock 100 to keep the remainder of the foot 300, which is positioned within the sock 100, warm.

Figure 4A:
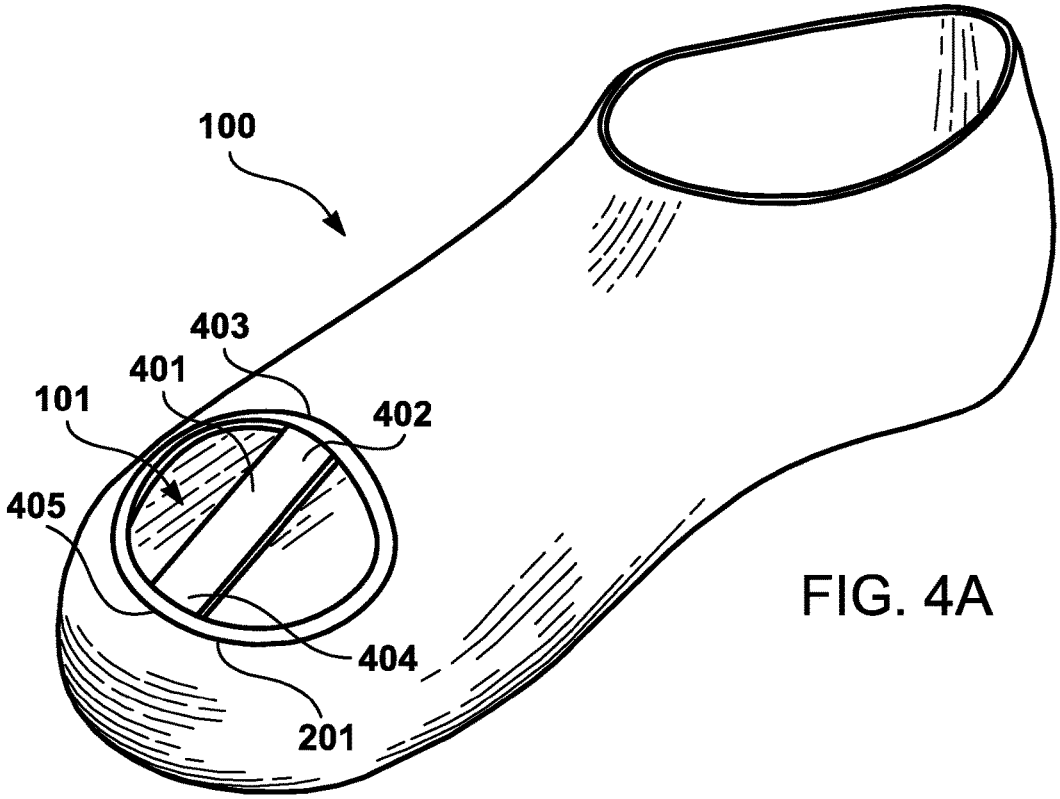
FIG. 4A illustrates the sock illustrated in FIG. 2A with a strip operably adhered to at least a portion of the dissipation ring.

In an alternative embodiment, the dissipation ring 201 may be reinforced to remove, or at least diminish, the possibility of the sock 100 illustrated in FIG. 2A tearing upon placement of the foot of the user. FIG. 4A illustrates the sock 100 illustrated in FIG. 2A with a strip 401 operably adhered to at least a portion of the dissipation ring 201. For example, the strip 401 may have a first end 402 that is adhered to a first portion 403 of the dissipation ring 201 and a second end 404 that is adhered to a second portion 405 of the strip. As a primary function, the strip 401 may optionally have an integrated, or adhered, disinfectant. Additionally, or alternatively, the strip 401 may optionally have a secondary function of reinforcement to resist pulling/pressing pressure exerted on the dissipation ring 201 during user wear of the sock 100.

The illustrated strip 401 is just one example. For instance, a plurality of horizontally-positioned, vertically-positioned, and/or diagonally-positioned strips 401 may be used to provide added reinforcement to the dissipation ring 201. Further, shapes (e.g., triangle, square, etc.) other than a rectangle may be used for the strip 401.

Figure 4B:
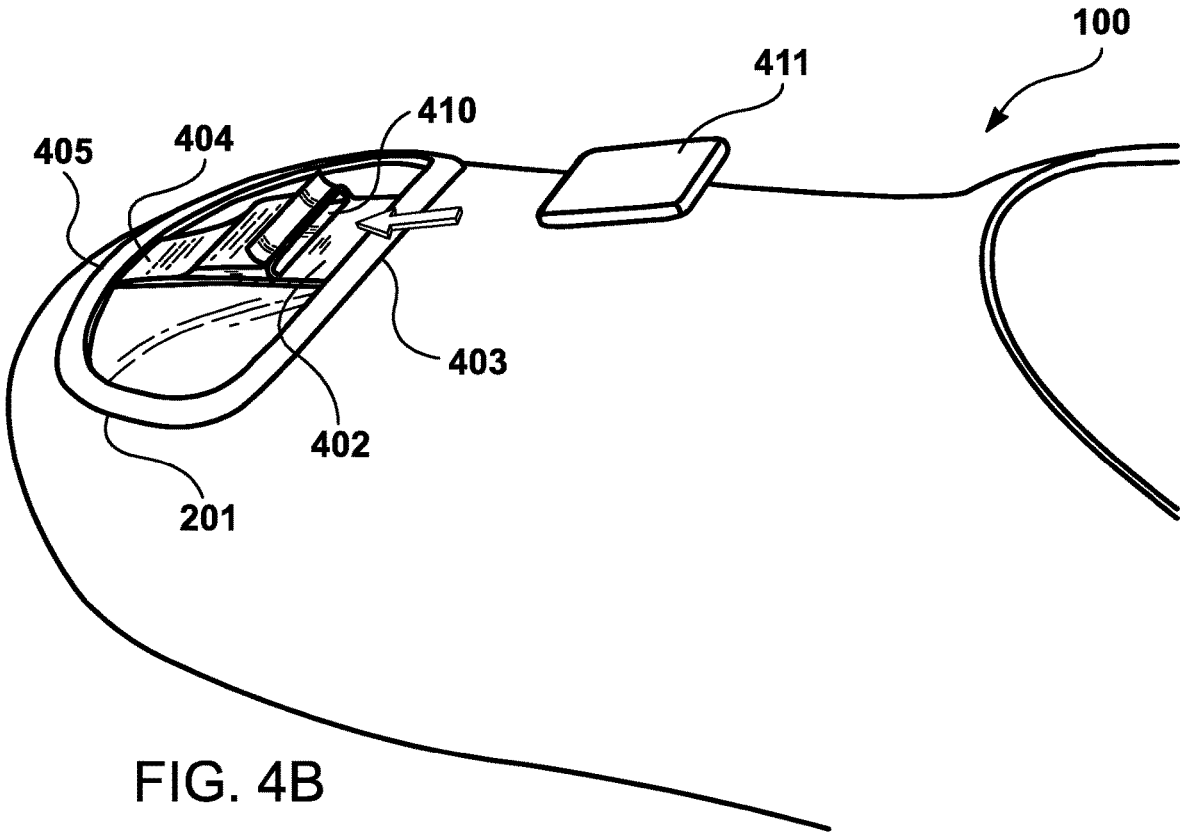
FIG. 4B illustrates a storage pouch that may be positioned on, or integrated within, the strip illustrated in FIG. 4A.

Moreover, FIG. 4B illustrates a storage pouch 410 that may be positioned on, or integrated within, the strip 401 illustrated in FIG. 4A. For instance, the storage pouch 410 may store an odor absorbent tablet 411 that reduces the odor emitted as a result of moisture build-up in the toe area. Alternatively, various forms of odor-absorbent chemicals may be stored in the storage pouch 410. For instance, the odor-absorbent chemicals may be stored in powder form, liquid form, etc. As yet another alternative, the materials stored in the storage pouch 410 may be used for moisture and/or heat absorption, wicking, etc. Further, as another alternative, the materials stored in the storage pouch 410 may be used as a disinfectant.

The storage pouch 410 may be adhered to various portions (e.g., center, an end portion, etc.) of the strip 401. Alternatively, the storage pouch 410 may be adhered directly to the dissipation ring 201.

Figure 5:
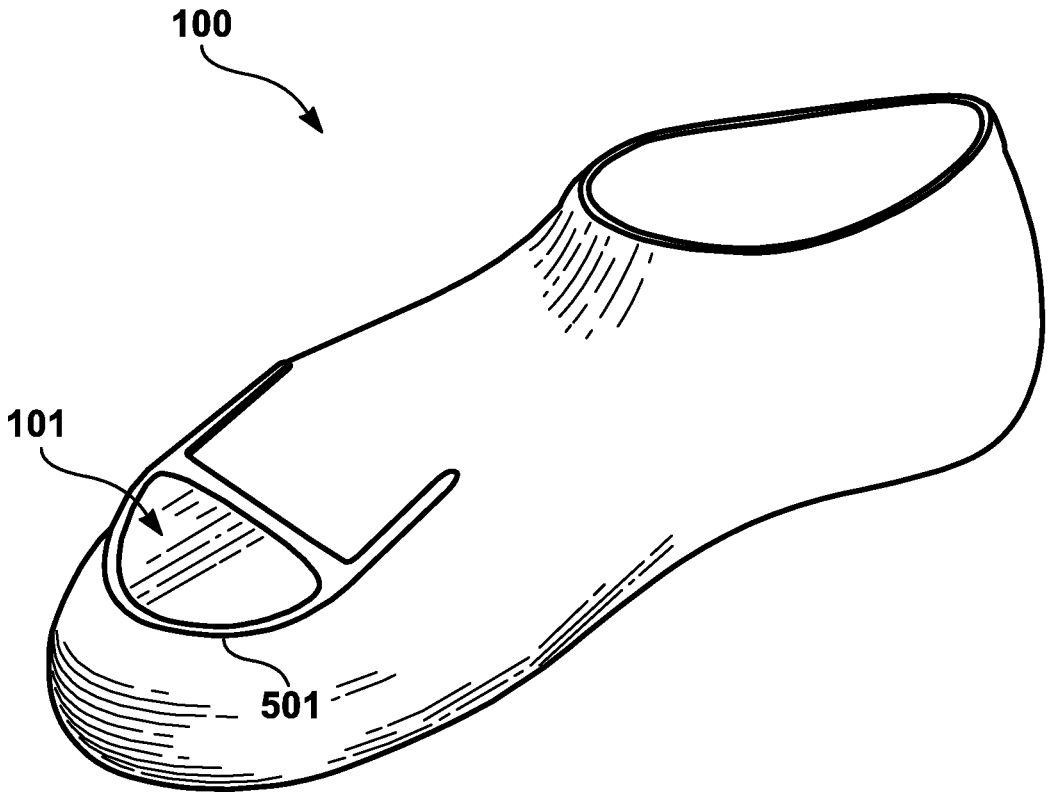
FIG. 5 illustrates a sock with a dissipation arc that is specific to an athletic shoe such as a sneaker.

In another embodiment, the sock 100 illustrated in FIG. 1 may be configured more specifically for an athletic shoe. FIG. 5 illustrates a sock 100 with a dissipation arc 501 that is specific to an athletic shoe such as a sneaker. As an example, the dissipation arc 501 may have a semicircular shape that is substantially similar in shape to the outline of human toes and the thin, breathable membrane placed above the toe area in an athletic sneaker. Accordingly, the semicircular shape provides optimal heat and moisture transfer from the sock 100. The dissipation arc 501 may be used with, or without, the strip 401 illustrated in FIG. 4.

Although not limited to any particular category, the various configurations provided for herein may be categorized in a manner that helps the user select a configuration that provides optimal heat and moisture transfer. For example, a user that is somewhat, but not extremely, active may select the configuration in which the dissipation ring 201 is in the shape of a circle, as illustrated in FIG. 3. As another example, a user that is extremely active (e.g., athletically active) may select the configuration with the dissipation arc 501, which has a semicircular shape, as illustrated in FIG. 5. As yet another example, a user that already has athlete's foot, or a foot odor problem, may select the configuration that has the strip 401, as illustrated in FIGS. 4A and 4B.

It is understood that the apparatuses described herein may also be applied in other types of apparatuses. Those skilled in the art will appreciate that the various adaptations and modifications of the embodiments of the apparatuses described herein may be configured without departing from the scope and spirit of the apparatuses. Therefore, it is to be understood that, within the scope of the appended claims, the present apparatuses may be practiced other than as specifically described herein.

I claim:

1. A sock comprising:

an ankle portion adapted to conform to an ankle of a wearer of the sock, the ankle portion comprising one or more ankle portion fibers;

a foot portion adapted to cover a foot sole of the wearer of the sock, the foot portion adapted to cover at least a portion of an instep of the wearer of the sock, the foot portion adapted to cover a portion of toes of the wearer of the sock without covering an exposed area of a remaining portion of the toes of the wearer of the sock, the foot portion comprising one or more foot portion fibers; and a single dissipation ring that is positioned on a top side of the foot portion without any additional dissipation rings positioned on the top side, the dissipation ring surrounding an opening within the top side, the dissipation ring adhered to the one or more foot portion fibers adjacent to the exposed area, the dissipation ring dissipating heat and absorption from the remaining portion of the toes of the wearer of the sock.

2. The sock of claim 1, wherein the single dissipation ring comprises one or more moisture absorbent chemicals.

3. The sock of claim 1, wherein the single dissipation ring comprises a circular shape.

4. The sock of claim 1, wherein the single dissipation ring comprises an oval shape.

5. The sock of claim 1, wherein the single dissipation ring comprises a semicircular shape.

6. The sock of claim 5, wherein the semicircular shape is adapted to conform to athletic footwear that is placed over the sock.

7. A sock comprising:

an ankle portion adapted to conform to an ankle of a wearer of the sock, the ankle portion comprising one or more ankle portion fibers;

a foot portion adapted to cover a foot sole of the wearer of the sock, the foot portion adapted to cover at least a portion of an instep of the wearer of the sock, the foot portion adapted to cover a portion of toes of the wearer of the sock without covering an exposed area of a remaining portion of the toes of the wearer of the sock, the foot portion comprising one or more foot portion fibers; and a strip adapted to partially cover an opening on a top side of the foot portion, the strip having a first end and a second end adhered to opposite ends of the opening, the first end being adhered to a first subset of the one or more foot portion fibers adjacent to the exposed area, the second end being adhered to a second subset of the one or more foot portion fibers adjacent to the exposed area, the strip providing ventilation between a first unadhered portion and the exposed area, the strip providing ventilation between a second unadhered portion and the exposed area.

8. The sock of claim 7, further comprising a storage pouch that stores one or more chemicals that absorb moisture, the storage pouch being adhered to the strip.

9. The sock of claim 7, further comprising a storage pouch that stores one or more chemicals that absorb odor, the storage pouch being adhered to the strip.

10. The sock of claim 7, wherein the strip is substantially rectangular in shape.

11. A sock comprising:

an ankle portion adapted to conform to an ankle of a wearer of the sock, the ankle portion comprising one or more ankle portion fibers;

a foot portion adapted to cover a foot sole of the wearer of the sock, the foot portion adapted to cover at least a portion of an instep of the wearer of the sock, the foot portion adapted to cover a portion of toes of the wearer of the sock without covering an exposed area of a remaining portion of the toes of the wearer of the sock, the foot portion comprising one or more foot portion fibers; and a single dissipation ring that is positioned on a top side of the foot portion without any additional dissipation rings positioned on the top side, the dissipation ring surrounding an opening within the top side, the dissipation ring adhered to the one or more foot portion fibers adjacent to the exposed area, the dissipation ring dissipating heat and absorption from the remaining portion of the toes of the wearer of the sock; and a strip adapted to partially cover an opening on a top side of the foot portion, the strip having a first end and a second end, the first end being adhered to a first section of the dissipation ring, the second end being adhered to a second section of the dissipation ring.

12. The sock of claim 11, wherein the single dissipation ring comprises one or more moisture absorbent chemicals.

13. The sock of claim 11, wherein the single dissipation ring comprises a circular shape.

14. The sock of claim 11, wherein the single dissipation ring comprises an oval shape.

15. The sock of claim 11, wherein the single dissipation ring comprises a semicircular shape.

16. The sock of claim 15, wherein the semicircular shape is adapted to conform to athletic footwear that is placed over the sock.

17. The sock of claim 11, further comprising a storage pouch that stores one or more chemicals that absorb moisture.

18. The sock of claim 17, wherein the storage pouch is adhered to the dissipation ring.

19. The sock of claim 17, wherein the storage pouch is adhered to the strip.

20. The sock of claim 11, further comprising a storage pouch that stores one or more chemicals that absorb odor.

* * * * *